US009408486B2

(12) United States Patent
Davis

(10) Patent No.: US 9,408,486 B2
(45) Date of Patent: Aug. 9, 2016

(54) FOOD SERVING ASSEMBLY

(71) Applicant: Danny W. Davis, Rockford, IL (US)

(72) Inventor: Danny W. Davis, Rockford, IL (US)

( * ) Notice: Subject to any disclaimer, the term of this patent is extended or adjusted under 35 U.S.C. 154(b) by 0 days.

(21) Appl. No.: 14/551,254

(22) Filed: Nov. 24, 2014

(65) Prior Publication Data

US 2016/0143466 A1 May 26, 2016

(51) Int. Cl.
*A47J 43/28* (2006.01)
*A47G 21/04* (2006.01)

(52) U.S. Cl.
CPC ..... *A47G 21/045* (2013.01)

(58) Field of Classification Search
CPC ..... A47J 43/18; A47J 43/283; A47J 21/045; B65G 7/12
USPC ..... 294/6–8, 173
See application file for complete search history.

(56) References Cited

U.S. PATENT DOCUMENTS

| | | | | |
|---|---|---|---|---|
| 2,502,982 | A | 4/1950 | Norman | |
| 2,571,465 | A | 10/1951 | McDevitt | |
| 4,114,265 | A | 9/1978 | Bailey | |
| D286,608 | S | 11/1986 | Leung | |
| 7,409,764 | B2 | 8/2008 | Akopyan | |
| D625,155 | S * | 10/2010 | Deshpande | D7/673 |
| D648,602 | S * | 11/2011 | Gray | D7/688 |
| 2003/0034662 | A1 | 2/2003 | Wilson | |
| 2008/0203747 | A1 * | 8/2008 | Stenglein | A47J 43/288 294/7 |
| 2012/0297548 | A1 * | 11/2012 | Solari | A47J 43/288 7/113 |

* cited by examiner

*Primary Examiner* — Stephen Vu

(57) ABSTRACT

A food serving assembly for removing the first slice of a pie without breaking the crust of the slice of pie includes a handle. A blade is coupled to the handle. The blade is segmented. The blade is positionable in a deflected position to be slid beneath the slice of pie without breaking the crust of the pie. The blade is positionable in a locked position to lift the slice of pie.

5 Claims, 4 Drawing Sheets

FOOD SERVING ASSEMBLY

BACKGROUND OF THE DISCLOSURE

Field of the Disclosure

The disclosure relates to serving devices and more particularly pertains to a new serving device for removing the first slice of a pie without breaking the crust of the slice of pie.

SUMMARY OF THE DISCLOSURE

An embodiment of the disclosure meets the needs presented above by generally comprising a handle. A blade is coupled to the handle. The blade is segmented. The blade is positionable in a deflected position to be slid beneath a slice of pie without breaking a crust of the pie. The blade is positionable in a locked position to lift the slice of pie.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
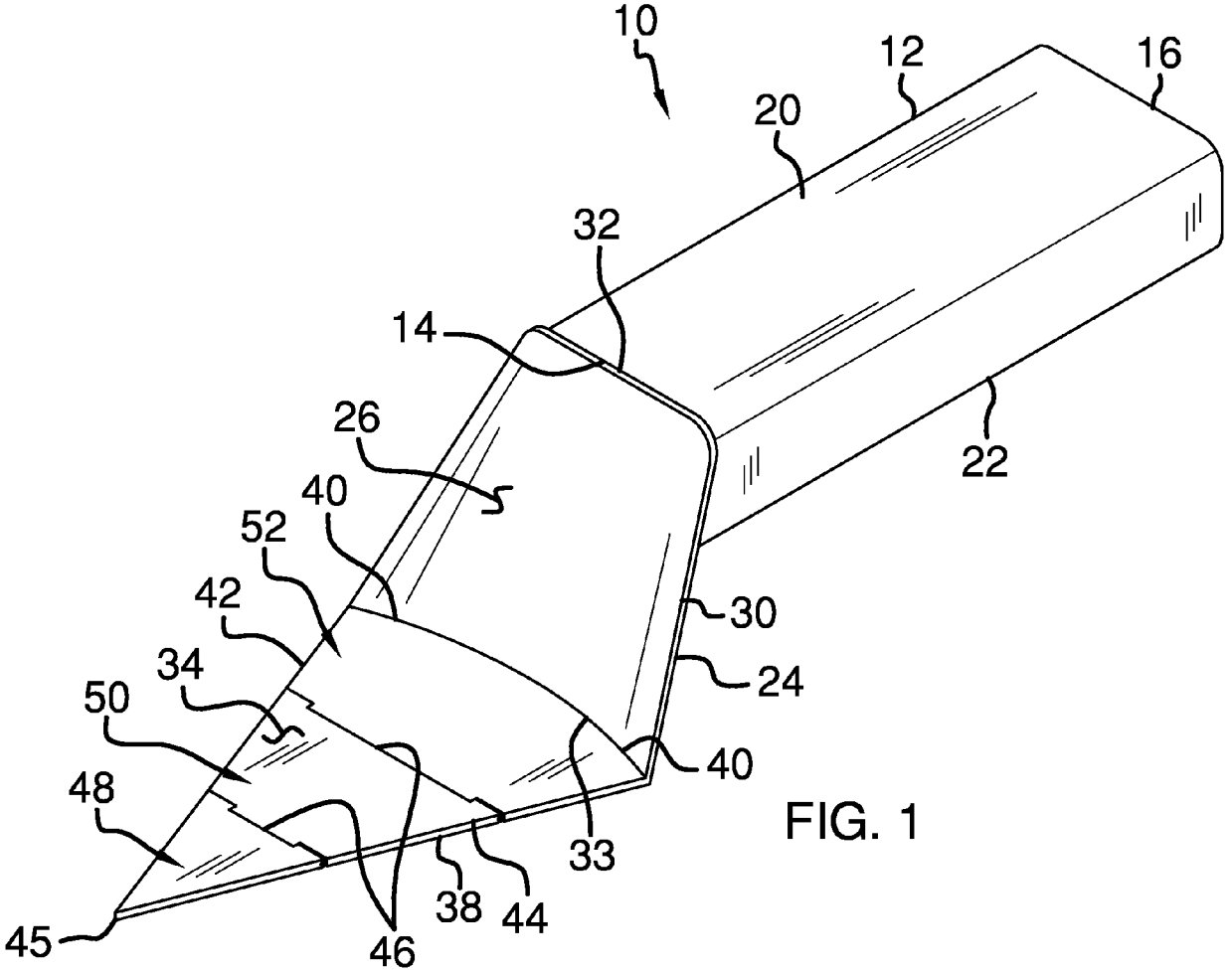
FIG. 1 is a perspective view of a food serving assembly according to an embodiment of the disclosure.
Figure 2:
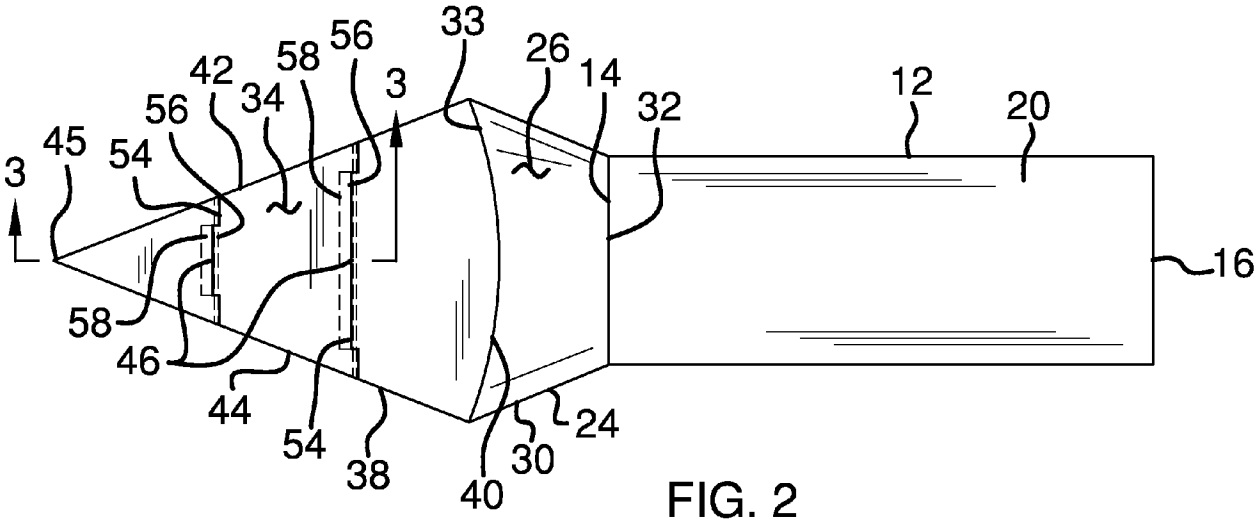
FIG. 2 is a top view of an embodiment of the disclosure.
Figure 4:
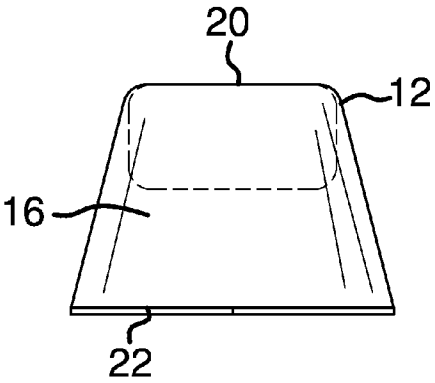
FIG. 4 is a back end view of an embodiment of the disclosure.
Figure 3:
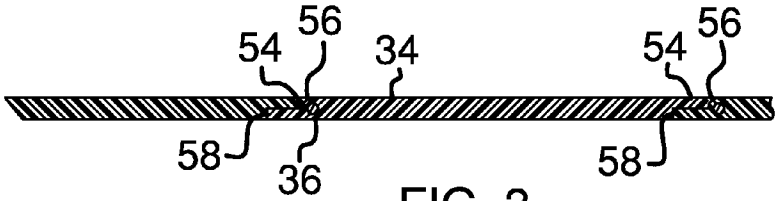
FIG. 3 is a cross sectional view taken along line 3-3 of FIG. 2 of an embodiment of the disclosure.
Figure 5:
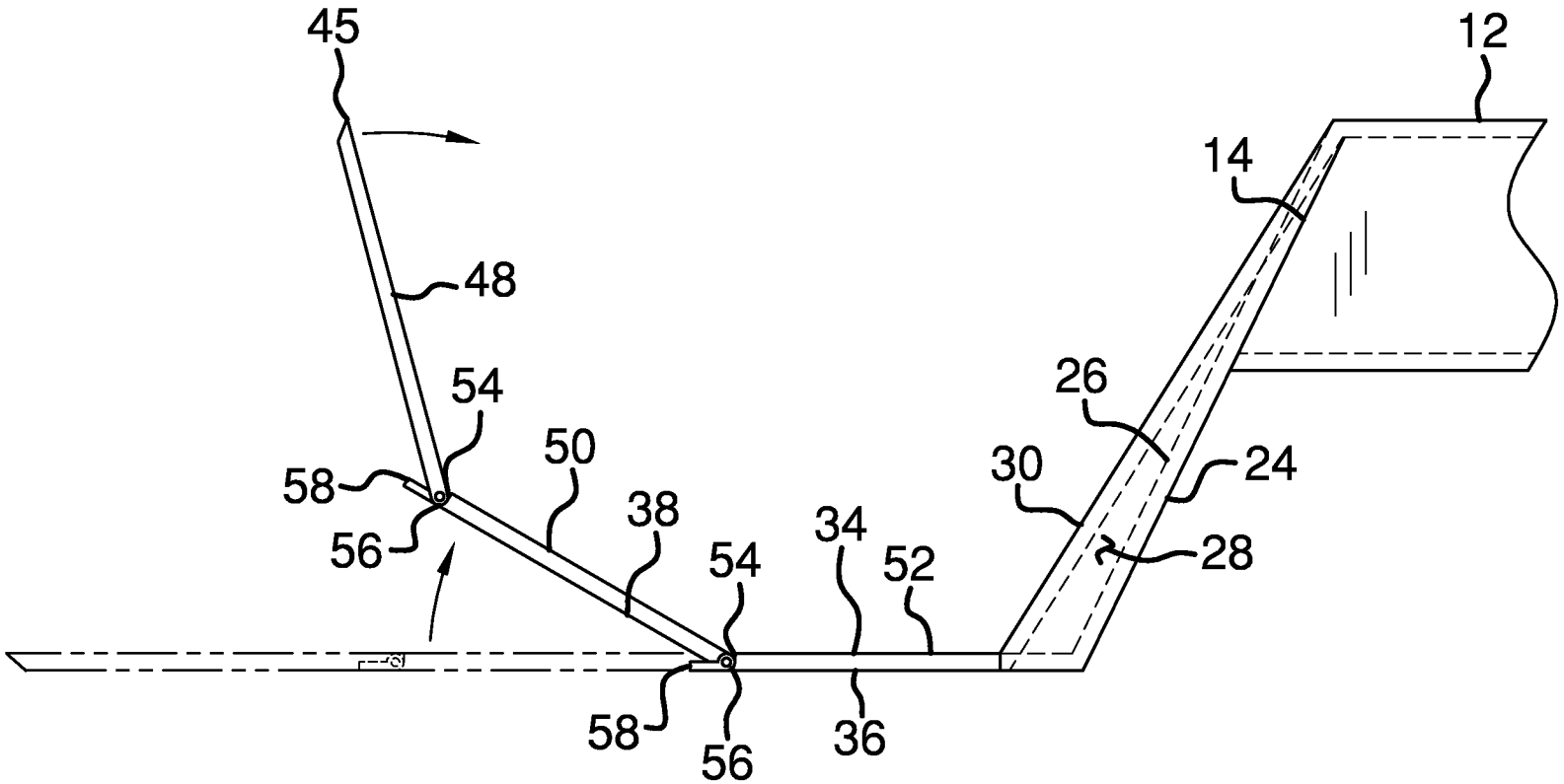
FIG. 5 is a left side view of an embodiment of the disclosure.
Figure 6:
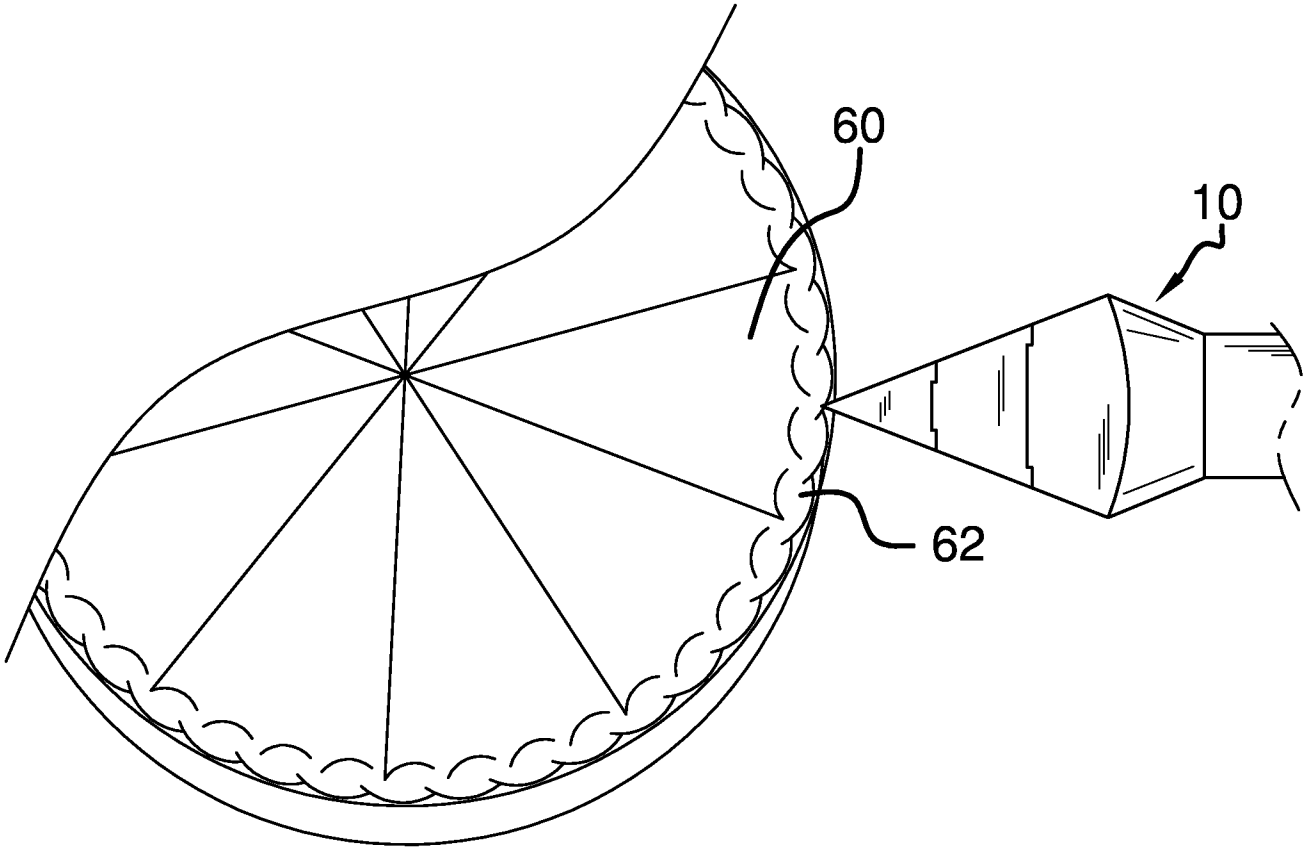
FIG. 6 is an in-use view of an embodiment of the disclosure.

With reference now to the drawings, and in particular to FIGS. 1 through 6 thereof, a new serving device embodying the principles and concepts of an embodiment of the disclosure and generally designated by the reference numeral 10 will be described.

As best illustrated in FIGS. 1 through 6, the food serving assembly 10 generally comprises a handle 12 that has a front end 14, a rear end 16 and a perimeter wall 18 extending between the front 14 and rear 16 ends. The front end 14 slopes forwardly from a top side 20 to a bottom side 22 of the perimeter wall 18. A stop 24 is provided. The stop 24 has a front surface 26, a rear surface 28 and an outer edge 30 extending between the front 26 and rear 28 surfaces. The outer edge 30 has an upper side 32 and a lower side 33.

The front 26 and rear 28 surfaces are curvilinear such that the stop 24 has a concave shape. The rear surface 28 is coupled to the front end 14 of the handle 12 such that the stop 24 extends downwardly from the handle 12. The upper side 32 of the outer edge 30 is positioned adjacent to the top side 20 of the perimeter wall 18 of the handle 12. The stop 24 is planar and lies on a plane oriented parallel to the front end 14.

A blade 32 has an upper surface 34, a lower surface 36 and an exterior edge 38 extending between the upper 34 and lower surfaces 36. The exterior edge 38 has a back side 40, a first lateral side 42 and a second lateral side 44. The first 42 and second 44 lateral sides taper to a point at a distal end 45 of the blade 32 with respect to the back side 40, giving the blade 32 a triangular shape. The back side 40 of the exterior edge 38 is coupled to the front surface 26 of the stop 24 such that the blade 32 extends forwardly from the stop 24. The back side 40 is positioned adjacent to the lower side 33 of the outer edge 30 of the stop 24.

The blade 32 has a pair of breaks 46 extending between the first 42 and second 44 lateral sides. The breaks 46 are spaced apart and distributed between the back side 40 and the distal end 45 to define a forward movable section 48, a middle movable section 50 and a fixed section 52. Each of the fixed section 52 and the middle movable sections 50 has a leading edge 54. Each of the forward movable 48 and the middle movable 50 sections has a rearmost edge 56. Each of the fixed section 52 and the middle movable section 50 has a tab 58 coupled to and extending forwardly from the leading edge 54. Each of the tabs 58 is centrally positioned on the leading edge 54.

The middle movable section 50 is hingedly coupled to the fixed section 52. The lower surface 36 corresponding to the middle movable section 50 abuts the tab 58 on the fixed section 52 when the middle movable section 50 is positioned in a locked position. The upper surface 34 corresponding to the middle movable section 50 is co-planar with the upper surface 34 corresponding to the fixed section 52.

The forward movable section 48 is hingedly coupled to the middle movable section 50. The lower surface 36 corresponding to the forward movable section 48 abuts the tab 58 on the middle movable section 50 when the forward movable section 48 is positioned in a locked position. The upper surface 34 corresponding to the forward movable section 48 lies on a plane that is co-planar with the upper surface 34 corresponding to the middle movable section 50. The blade 32 may lift a slice of pie 60 when the forward 48 and middle 50 movable sections are in the locked position.

The upper surface 34 corresponding to each of the forward 48 and middle 50 movable sections is positionable at a selected angle with respect to the upper surface 34 corresponding to the fixed section 52 when each of the forward 48 and middle 50 movable sections is positioned in a deflected position. The blade 12 may be slid beneath the slice of pie 60 without breaking a crust 62 of the pie 60 when the forward 48 and middle 50 movable sections are in the deflected position.

In use, the distal end 45 of the blade 32 is inserted beneath the slice of pie 60. The forward movable section 48 is positioned in the deflected position as the middle movable section 50 is urged toward the slice of pie 60. The middle movable section 50 is positioned in the deflected position as the middle movable section 50 is inserted beneath the slice of pie 60. The forward movable section 48 is placed in the locked position as the middle movable section 50 is positioned inserted beneath the slice of pie 60. The middle movable section 50 is positioned in the locked position as the fixed section 52 is slid beneath the slice of pie 60. The slice of pie 60 is lifted after the blade 32 is fully inserted beneath the slice of pie 60.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A food serving assembly configured to remove a slice of pie without compromising a crust of the pie, said assembly comprising:

a handle;

a stop having a front surface, a rear surface and an outer edge extending between said front and rear surfaces, said outer edge having an upper side and a lower side; and a blade coupled to said handle, said blade being segmented, said blade being positionable in a deflected position wherein said blade is configured to be slid beneath a slice of pie without breaking a crust of the pie, said blade being positionable in a locked position wherein said blade is configured to lift the slice of pie, said blade having an upper surface, a lower surface and an exterior edge extending between said upper and lower surfaces, said exterior edge having a back side, a first lateral side and a second lateral side, said first and second lateral sides tapering to a point at a distal end of said blade with respect to said back side such that said blade has a triangular shape, said back side of said exterior edge being coupled to said front surface of said stop such that said blade extends forwardly from said stop, said back side being positioned adjacent to said lower side of said of said outer edge of said stop, said blade having a pair of breaks extending between said first and second lateral sides, said breaks being spaced apart and distributed between said back side and said distal end to define a forward movable section, a middle movable section and a fixed section, each of said fixed and said middle movable sections having a leading edge, each of said forward and said movable sections having a rearmost edge, each of said fixed section and said middle movable section having a tab coupled to and extending forwardly from said leading edge, each of said tabs being centrally positioned on said leading edges, said middle movable section being hingedly coupled to said fixed section, said lower surface corresponding to said middle movable section abutting said tab on said fixed section when said middle movable section is positioned in a locked position such that said upper surface corresponding to said middle movable section is co-planar with said upper surface corresponding to said fixed section, said forward movable section being hingedly coupled to said middle movable section, said lower surface corresponding to said forward movable section abutting said tab on said middle movable section when said forward movable section is positioned in a locked position such that said upper surface corresponding to said forward movable section lies on a plane being co-planar with said upper surface corresponding to said middle movable section, said upper surface corresponding to each of said forward and middle movable sections being positionable at a selected angle with respect to said upper surface corresponding to said fixed section when each of said forward and movable sections is positioned in a deflected position.

2. The assembly according to claim 1, wherein said handle having a front end, a rear end and a perimeter wall extending between said front and rear ends, said front end sloping forwardly from a top side to a bottom side of said perimeter wall.

3. The assembly according to claim 2, further comprising a stop having a front surface, a rear surface and an outer edge extending between said front and rear surfaces, said outer edge having an upper side and a lower side.

4. The assembly according to claim 3, wherein said rear surface being coupled to said front end of said handle such that said stop extends downwardly from said handle, said upper side of said outer edge being positioned adjacent to said top side of said perimeter wall of said handle, said stop being planar and lying on a plane oriented parallel to said front end.

5. A food serving assembly configured to remove a slice of pie without compromising a crust of the pie, said assembly comprising:

a handle having a front end, a rear end and a perimeter wall extending between said front and rear ends, said front end sloping forwardly from a top side to a bottom side of said perimeter wall;

a stop having a front surface, a rear surface and an outer edge extending between said front and rear surfaces, said outer edge having an upper side and a lower side, said rear surface being coupled to said front end of said handle such that said stop extends downwardly from said handle, said upper side of said outer edge being positioned adjacent to said top side of said perimeter wall of said handle, said stop being planar and lying on a plane oriented parallel to said front end;

a blade having an upper surface, a lower surface and an exterior edge extending between said upper and lower surfaces, said exterior edge having a back side, a first lateral side and a second lateral side, said first and second lateral sides tapering to a point at a distal end of said blade with respect to said back side such that said blade has a triangular shape, said back side of said exterior edge being coupled to said front surface of said stop such that said blade extends forwardly from said stop, said back side being positioned adjacent to said lower side of said outer edge of said stop, said blade having a pair of breaks extending between said first and second lateral sides, said breaks being spaced apart and distributed between said back side and said distal end to define a forward movable section, a middle movable section and a fixed section, each of said fixed and said middle movable sections having a leading edge, each of said forward and said movable sections having a rearmost edge, each of said fixed section and said middle movable section having a tab coupled to and extending forwardly from said leading edge, each of said tabs being centrally positioned on said leading edges, said middle movable section being hingedly coupled to said fixed section, said lower surface corresponding to said middle movable section abutting said tab on said fixed section when said middle movable section is positioned in a locked position such that said upper surface corresponding to said middle movable section is co-planar with said upper surface corresponding to said fixed section, said forward movable section being hingedly coupled to said middle movable section, said lower surface corresponding to said forward movable section abutting said tab on said middle movable section when said forward movable section is positioned in a locked position such that said upper surface corresponding to said forward movable section lies on a plane being co-planar with said upper surface corresponding to said middle movable section wherein said blade is configured to lift a slice of pie, said upper surface corresponding to each of said forward and middle movable sections being positionable at a selected angle with respect to said upper surface corresponding to said fixed section when each of said forward and middle movable sections is positioned in a deflected position wherein said blade is configured to be slid beneath a slice of pie without breaking a crust of the pie.

* * * * *